United States Patent [19]

Saya

[11] 4,234,874

[45] Nov. 18, 1980

[54] ALARM SYSTEM AND METHOD THEREOF

[75] Inventor: Wayne P. Saya, Cambridge, Mass.

[73] Assignee: Inventional/Security Development Corp., Cambridge, Mass.

[21] Appl. No.: 958,822

[22] Filed: Nov. 8, 1978

[51] Int. Cl.[2] ..... G08B 1/08

[52] U.S. Cl. ..... 340/539; 455/27

[58] Field of Search ..... 340/539; 325/113, 155, 325/30, 56, 33, 122, 154, 157, 166; 360/73; 178/22

[56] References Cited

U.S. PATENT DOCUMENTS

| | | | |
|---|---|---|---|
| 2,522,615 | 9/1950 | Hughes | 340/539 |
| 3,044,015 | 7/1962 | Overkamp, Jr. et al. | 325/166 |
| 3,909,722 | 9/1975 | Bennett, Jr. | 340/539 |
| 4,109,239 | 8/1978 | Davis | 340/539 |

FOREIGN PATENT DOCUMENTS

| | | | |
|---|---|---|---|
| 156945 | 6/1954 | Australia | 340/539 |
| 1031567 | 3/1953 | France | 340/539 |

*Primary Examiner*—Thomas A. Robinson
*Attorney, Agent, or Firm*—Laurence R. Brown

[57] ABSTRACT

A burglar or fire alarm is presented which cannot be disabled by cutting the power or telephone lines and which virtually cannot be radio jammed. A radio transmitter comprises an automatic switch which repetitiously and cyclically switches the carrier frequency of the transmitter between a plurality of frequencies in seriatim for transmission of an alarm signal to a distant receiver so that if at least one of the frequencies is rendered unusable by burglars by jamming or the like, the other of said frequencies will still be usable. A tape player provided with a pre-recorded message signalling an alarm condition is connected to modulate the carrier frequencies. A speed adjustment means is provided for the tape player for changing the playing time for said message. The speed adjustment permits the tape player to play back the message for transmission at a plurality of rates including an increased rate too fast for human comprehension for communication with a computer.

2 Claims, 2 Drawing Figures

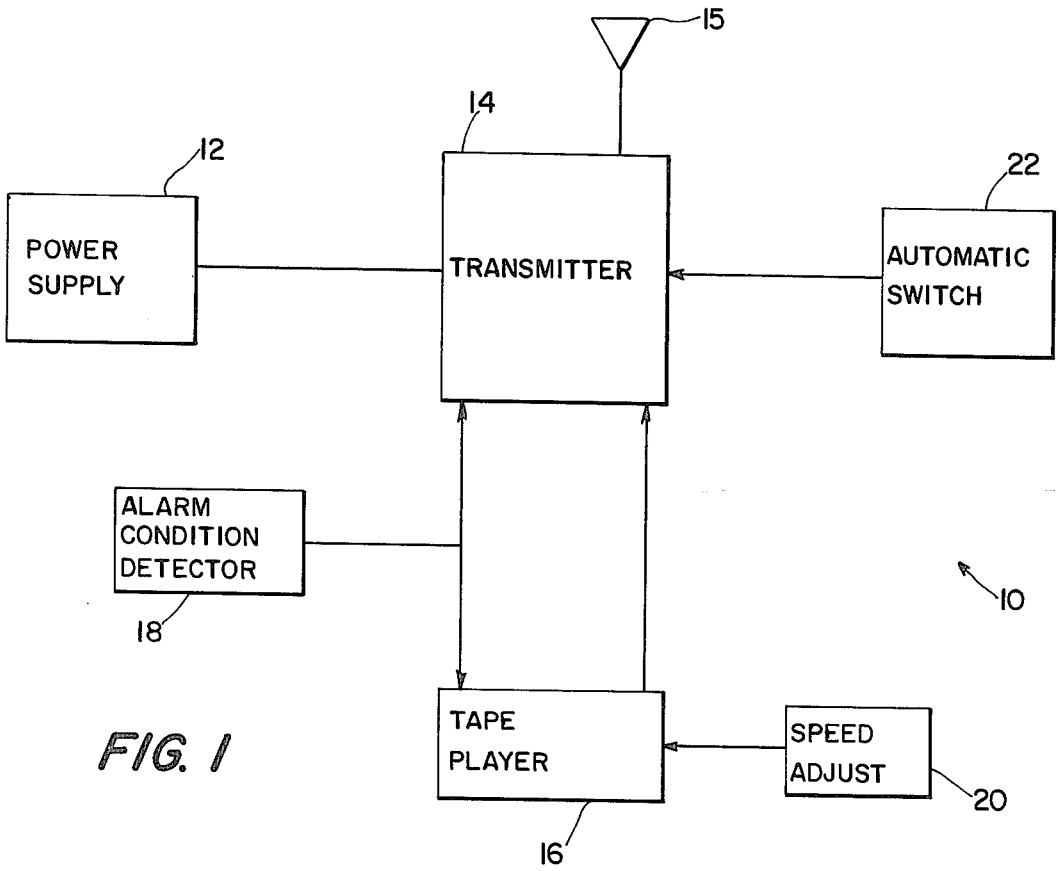
FIG. 1
FIG. 2
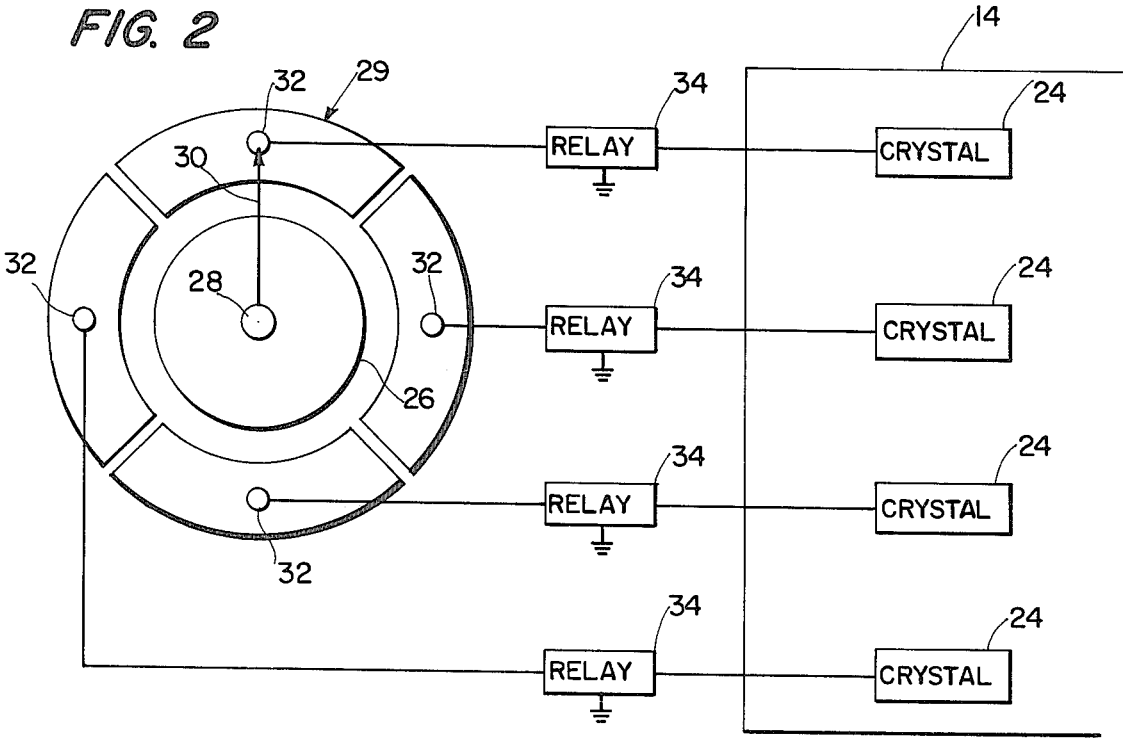

ALARM SYSTEM AND METHOD THEREOF

TECHNICAL FIELD

The present invention relates to alarm systems and particularly, to burglar and fire alarm systems having a virtually unjammable radio transmitter for transmitting an indication of an alarm condition to a distant receiver.

BACKGROUND ART

Burglar alarms often require connecting links such as AC power supply and telephone lines which make them vulnerable and easily defeated by experienced burglars by cutting said lines. Even if the receiver is designed to detect the cutting of the telephone line, the alarm system can be defeated by first splicing an external shunt across the telephone line prior to the cutting thereof.

To avoid the above problems and to eliminate the substantial cost of maintaining a leased telephone line (unless an automatic dialer is included) which also limits the distance between transmitter and receiver, many prior art alarm systems use a radio transmitter. Exemplary patents using radio transmitters are: Fowler, U.S. Pat. Nos. 4,012,728; Solomon, 3,889,250; Isaacs, 3,795,896; and McQuown Jr., 3,760,359. However, radio transmitters are susceptible to interference and to being defeated by jamming or otherwise making the designated transmitter frequency unusable so that the alarm signal will not be received or be usable by a distant receiver. If multiple transmitters are used to broadcast the alarm over a plurality of frequencies such an arrangement presents a considerable extra expense. The present invention overcomes this difficulty by providing a single transmitter having a plurality of transmitting frequencies. The frequencies are switched and transmitted in seriatim thereby using only one transmitter to broadcast on a plurality of frequencies and thereby overcoming the potential jamming problem and providing a much more economical way for broadcasting on a plurality of frequencies than to use a plurality of transmitters.

Once an alarm condition is detected, it is common practice to transmit a verbal alarm signal which has been previously recorded. Such examples in the prior art are exemplified in Smith, U.S. Pat. Nos. 3,596,024 which uses a tape player using an endless tape which is continuously repeated, and Andrews, 3,207,849 and Stradley, 2,847,507 which use a phonograph.

McCorkindale, U.S. Pat. No. 3,257,653, shows transmitting a communication which requires decoding equipment or a computer for a read out.

McCorkindale does not show a tape player which can play an audible comprehensible message as well as a greatly speeded up message compressed in time for communications with a computer but not comprehensible to a human. The increased rate has the advantage of using the computer capability more effectively and not wasting computer time and additionally, has the very important advantage that if the transmission is being monitored by the intruders, it will not make sense to them and they will not be forewarned of the danger that police authorities will be arriving shortly. Further, if the burglars intend to jam the transmitter only when the message is transmitted, the message will be transmitted and finished before the intruders have time to react.

Accordingly, it is an object of the present invention to provide an apparatus and method overcoming the above problems.

A further object is to provide an alarm system that virtually cannot be jammed or disabled. Still another object is to provide an alarm system and method therefor including a radio transmitter wherein the carrier frequency of said transmitter is repetitiously and cyclically switched between a plurality of frequencies in seriatim so that if at least one of the frequencies is rendered unusable by the burglars or the like, the other of said frequencies will still be usable and the indication of an alarm condition will be transmitted and received by a distant receiver. Yet another object is to provide an alarm system and method therefor including a magnetic tape player having a pre-recorded message wherein the tape player is provided with a speed adjustment means so that the playback speed of the pre-recorded message can be greatly increased so that it is not comprehensible to a human but can be understood by a computer. Further objects and advantages of the present invention will become apparent as the following description proceeds and the features of novelty characterizing the invention will be pointed out with particularity in the claims annexed to and forming a part of this specification.

DISCLOSURE OF THE INVENTION

The present invention presents a burglar alarm having a power supply, a transmitter powered by the power supply and operatively connected to an alarm condition detecting device, and a magnetic tape player having a pre-recorded message for transmission signalling the alarm condition. The transmitter includes a carrier frequency generator and a plurality of frequency determining elements such as quartz crystals. The frequency determining elements are repetitively and cyclically switched in seriatim by an automatic switch so that the frequency of transmission is changed at regular time intervals to prevent jamming of the transmission by burglars or the like. The automatic switch comprises a rotary selector switch with the rotary pole driven by a timing motor. The selector switch energizes in seriatim the coils of relays the contacts of which in turn connect the crystals to ground one at a time. The tape player is provided with a speed adjustment so that the pre-recorded message can be played back at an audible speed for comprehension by a human, at an increased speed to provide a beep indication, or at a greatly increased speed incomprehensible to humans for communication with a computer.

BRIEF DESCRIPTION OF DRAWINGS

For a better understanding of the present invention reference may be had to the accompanying drawings wherein the same reference numerals have been applied to like parts and wherein:

FIG. 1 is a block diagram of the alarm system of the invention, and

FIG. 2 is a block diagram of the frequency cycling system afforded by this invention.

BEST MODE FOR CARRYING OUT THE INVENTION

Referring now to FIG. 1, there is shown an alarm system, generally designated 10, comprising a power supply 12, a radio transmitter 14 having an antenna 15, a magnetic tape player 16, and an alarm condition detector or sensor 18. When the sensor 18 is triggered or activated, the transmitter 14, powered by the power supply 12, transmits an alarm signal or indication. The tape player 16 which is also activated by the sensor 18, is provided with a pre-recorded message and is connected to modulate the carrier wave of the transmitter with said message. The playing speed of the tape player 16 is adjustable by speed adjust 20. An automatic switch 22 is connected to the transmitter 14 for repetitively and cyclically changing the carrier frequency of the transmitter so that the message is sequentially broadcast on a plurality of frequencies to prevent burglars or the like from jamming the message transmission.

More particularly, the power supply 12 includes an AC supply for changing 120 volts AC to 12 volts DC, a back up battery, and appropriate means for turning the alarm system on and off and switching in the back-up battery if the AC power supply should fail, all of which are old in the art, so that the alarm system cannot be disabled by disconnecting the AC power.

The detector or sensor 18 can be any available burglar alarm sensor or switch, a fire or temperature detector, or any other sensor for any other purpose desired. When the alarm detector 18 is triggered and an alarm condition is thereby indicated, an indication of the alarm condition is broadcast. To overcome the possibility that burglars or the like might jam or otherwise render the broadcast frequency of the transmitter inoperable, the frequency of transmission is repetitiously and cyclically switched between a plurality of predetermined frequencies in seriatim in a timed sequence until the proper authorities arrive and the alarm is reset.

The tape player 16 is, in the exemplary embodiment, a reel to reel machine provided with an endless loop tape having a pre-recorded message thereon. The tape player 16 is activated by the sensor 18 and is connected to modulate the carrier of the transmitter with the pre-recorded message. The pre-recorded message can be a verbal message giving the location of the premises or it can be a numerically coded message. Although the tape player in the present embodiment is a reel to reel machine, a cassette or cartridge recorder can be used.

The tape player 16 is provided with a speed adjust 20 for varying the playback rate of the pre-recorded message. The speed adjust of the exemplary embodiment is a variable resistor connected to the motor of the tape player; however, it is within the contemplation of the present invention that the speed adjust can comprise a variable electronic drive for the motor such as a variable electronic motor regulator, or a mechanical adjust such as a movable puck or belt drive coupled to the capstan of the recorder. The speed adjust 20 can adjust the speed of the tape player 16 over a wide range of speeds from a standard playback rate to an ultra-fast playback rate too fast for human comprehension but able to be decoded by a computer located at the receiver. The ultrafast playback rate permits economic use of the computer time as well as making the message transmission more difficult to jam as discussed hereinbefore.

The transmitter 14, as discussed above, is provided with multiple carrier frequency capability. The transmitter 14 comprises a plurality of frequency determining elements, the exemplary embodiment having quartz crystals 24 (FIG. 2) for determining the carrier frequency. It is within the contemplation of the present invention that the frequency determining element can be a capacitor or inductor depending on the type of oscillator used. Such oscillators are commonplace and old in the art; however, it is desirable that an oscillator be chosen where the frequency determining element being switched is switched to ground so that only one lead going to the switch 22 is above ground to reduce stray capacitance effects.

Referring to FIG. 2, the automatic switch 22 comprises a motor 26 having a shaft 28. The motor 26 is powered from the power supply 12 and rotatably drives the common switching pole 30 of a rotary switch wherein the shaft rotates at 1.0 rpm. It is preferred that the drive motor be similar to the timer motor of a clothes washing machine or the like so that the pole 30 will stay connected to one of the contacts 32 for a predetermined period of time before switching to the next contact. In this manner, the transmitter broadcasts on one of the frequencies for a predetermined period of time before switching to the next frequency. In the exemplary embodiment, the frequency is switched every 45 seconds using four different channels or frequencies with the message being broadcast during only a portion of each switched interval. The frequencies are switched in a repetitious and cyclic manner in seriatiom until proper authorities arrive.

The switched contacts or connections 32 are each connected to a respective relay 34 which controls a respective one of the crystals 24. In the exemplary embodiment, the relay coils are connected to a voltage and the other side of the relay coil is connected to ground through the rotor 30. The switched contacts of the relay are normally open and switch one side of the respective crystals 24 to ground when the relay is activated. It is within the contemplation of the present invention that the crystals 24 can be switched directly to ground in seriatim by the rotor 30; however, the relays 34 can be disposed close to the crystals 24 while permitting the switch 29 and motor 26 to be disposed distant from the crystals. In such an arrangement, the lead lengths from the crystals 24 are kept short thereby eliminating stray capacitance and lead inductive effects at high frequencies.

It is also within the contemplation of the present invention that the switching between frequency determining elements can be accomplished electronically such as by switching diodes driven by an electronic timer. In such a case, the electronic timer can be a low frequency oscillator, a crystal controlled oscillator with electronic dividers such as multivibrators or the like, or the timing frequency be derived from the line frequency with said electronic dividers.

INDUSTRIAL APPLICABILITY

The present invention presents an alarm system which is virtually unjammable. The alarm system can be used to insure the security and safety of remote structures or to protect warehouses, offices, or the like through the night from intrusion or fire. The present alarm is also immune to windblown downed telephone and power lines and therefore will not produce a false alarm in such an event which would otherwise endanger firemen, police, or the like coming in response to such a false alarm during snow, ice, or heavy rains.

I claim

1. An alarm system responsive to an alarm condition detector to communicate a message to a distant radio receiver system operable to receive messages on a plurality of frequencies, featuring fail safe features that prevent disabling the system by cutting wires or jamming transmission, comprising in combination, a battery operated power supply permitting operation when power lines are disabled, a radio transmitter operable from said power supply for transmitting an alarm message on a plurality of different radio broadcast frequency channels receivable by said distant receiver system, alarm message repeater means operable from said power supply having a pre-recorded audio message signal reproducible at audio reproduction rates greatly increased over comprehensible audible speeds and thus incomprehensible to humans and to be transmitted rapidly before jamming analysis can be effective, means responsive to an alarm condition connected for activating said alarm message repeater to modulate said transmitter with said signal at said reproduction rates, and means activating said transmitter to broadcast the recorded signal on each of the different frequency channels including means operable from said power supply selecting a cyclic sequence of said plurality of different frequencies at a repetition rate of a few seconds timed so that the transmitter will repeat the message on each of the plurality of frequencies thereby permitting effective radio transmission of the alarm message to the distant receiver in the presence of jamming of any less than all said plurality of different broadcast frequency channels.

2. The method of transmitting an alarm signal of the radio broadcast type in response to detection of an alarm condition for reception at a receiver system adapted to receive the message on a plurality of frequency bands in a mode to avoid possibility of disabling the alarm by burglars or arsonists, comprising the steps of, repeating at a repetition rate of a few seconds a recorded audio message upon receipt of an alarm condition at a rate too fast for human comprehension, to thereby reduce the time available for analysis of the signal by an intruder for jamming and the comprehensibility of the message being transmitted, and modulating the audio message upon a succession of cyclically presented frequencies receivable by the receiver system and broadcasting those messages so that the received message on any of the frequencies will indicate an alarm condition, thereby preventing disablement of the system by jamming less than all the cyclically presented frequencies.

* * * * *